US011798464B2

(12) United States Patent
Hwang et al.

(10) Patent No.: US 11,798,464 B2
(45) Date of Patent: Oct. 24, 2023

(54) DISPLAY DEVICE AND METHOD OF DRIVING DISPLAY DEVICE

(71) Applicant: Samsung Display Co., Ltd., Yongin-si (KR)

(72) Inventors: Young-Soo Hwang, Suwon-si (KR); Joon-Chul Goh, Suwon-si (KR); Dongjoon Kwag, Yongin-si (KR); Hyungjin Kim, Seoul (KR); Ji-Eun Park, Suwon-si (KR); Jaesung Bae, Suwon-si (KR); Seokha Hong, Seoul (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/900,137

(22) Filed: Aug. 31, 2022

(65) Prior Publication Data

US 2023/0128265 A1 Apr. 27, 2023

(30) Foreign Application Priority Data

Oct. 27, 2021 (KR) ..... 10-2021-0144823

(51) Int. Cl.
*G09G 3/32* (2016.01)

(52) U.S. Cl.
CPC ..... *G09G 3/32* (2013.01); *G09G 2300/0842* (2013.01); *G09G 2320/0233* (2013.01); *G09G 2320/048* (2013.01)

(58) Field of Classification Search
CPC ..... G09G 3/32; G09G 2300/0842; G09G 2320/0233; G09G 2320/048
See application file for complete search history.

(56) References Cited

U.S. PATENT DOCUMENTS

| | | | | |
|---|---|---|---|---|
| 8,589,100 | B2 | 11/2013 | Chaji et al. | |
| 10,937,351 | B2 * | 3/2021 | Meng | G09G 3/20 |
| 11,017,715 | B2 * | 5/2021 | Wang | G09G 3/3208 |
| 11,250,791 | B2 * | 2/2022 | Chen | G09G 3/34 |
| 11,508,942 | B2 * | 11/2022 | Xie | H10K 71/00 |
| 11,514,797 | B2 * | 11/2022 | Poulose | G02B 27/01 |
| 11,574,577 | B2 * | 2/2023 | Zhai | G09G 5/02 |
| 2022/0238079 | A1 * | 7/2022 | Yu | G09G 3/3648 |

FOREIGN PATENT DOCUMENTS

| | | |
|---|---|---|
| KR | 1020150136138 A | 3/2016 |
| KR | 1020200019321 A | 2/2020 |

* cited by examiner

*Primary Examiner* — Gene W Lee
(74) *Attorney, Agent, or Firm* — CANTOR COLBURN LLP

(57) ABSTRACT

A display device includes a degradation compensator, a controller, a data driver, and a display panel. The degradation compensator generates a first fitting function and a second fitting function based on image data, generates a compensation function through a harmonic mean of the first and second fitting functions, and generates a compensation value based on the compensation function. The controller receives the compensation value, and generates input image data to which the compensation value is applied. The data driver receives the input image data to which the compensation value is applied, and converts the input image data into a data voltage. The display panel includes pixels, in which each of the pixels includes a pixel circuit which receives the data voltage and a light-emitting element electrically connected to the pixel circuit.

20 Claims, 9 Drawing Sheets

FIG. 3

310

$$\exp[-(t/\tau)^{\beta}]$$

320

$$a \cdot \exp[b \cdot t]+c$$

330

$$\frac{2xy}{x+y}$$

DISPLAY DEVICE AND METHOD OF DRIVING DISPLAY DEVICE

This application claims priority to Korean Patent Application No. 10-2021-0144823, filed on Oct. 27, 2021, and all the benefits accruing therefrom under 35 U.S.C. § 119, the content of which in its entirety is herein incorporated by reference.

BACKGROUND

1. Field

Embodiments relate generally to a display device and a method of driving a display device. More particularly, embodiments of the invention relate to a display device including an inorganic light-emitting diode a method of driving a display device including an inorganic light-emitting diode.

2. Description of the Related Art

Flat panel display devices are used as display devices for replacing a cathode ray tube display device due to light-weight and thin characteristics thereof. Representative examples of such flat panel display devices include a liquid crystal display device, an organic light-emitting display device, a quantum dot display device, or the like.

SUMMARY

A luminance of the display device may be decreased according to a driving time and a driving current amount, and such a phenomenon may degrade display quality of the display device. A light-emitting element of the display device may be non-uniformly degraded according to the driving time so that an afterimage may appear, and a color shift may be caused by a difference in degradation rates of red, green, and blue light-emitting elements, for example. In other words, a luminance of the light-emitting element may be reduced by degradation of the light-emitting element, and non-uniform degradation may be caused among the light-emitting elements according to a usage time of the light-emitting element.

Embodiments provide a display device with improved display quality.

Embodiments provide a method of driving a display device with improved display quality.

In an embodiment of the invention, a display device includes a degradation compensator, a controller, a data driver, and a display panel. The degradation compensator generate a first fitting function and a second fitting function based on image data, generate a compensation function through a harmonic mean of the first and second fitting functions, and generate a compensation value based on the compensation function. The controller receive the compensation value, and generate input image data to which the compensation value is applied. The data driver receive the input image data to which the compensation value is applied, and convert the input image data into a data voltage. The display panel includes pixels, in which each of the pixels includes a pixel circuit which receives the data voltage and a light-emitting element electrically connected to the pixel circuit.

In an embodiment, the first fitting function may include an exponential function in which a luminance value of the pixel with respect to a degradation time of the pixel is gradually decreased.

In an embodiment, the first fitting function may be expressed by a first mathematical formula "$\exp[-(t/\tau)^{\beta}]$", where $\tau$ is a time desired for an initial luminance of a pixel to be degraded to a preset reference (decay time constant), $\beta$ is a parameter related to a degradation form of a pixel, which is a constant determined for each of pixels regardless of a gray level, and t is a degradation time of a pixel.

In an embodiment, the second fitting function may include an exponential function in which a luminance value of the pixel is gradually decreased after the luminance value of the pixel is increased during an initial degradation time of the pixel.

In an embodiment, the second fitting function may be expressed by a second mathematical formula "$a \cdot \exp[b \cdot t]+c$", where c is an initial luminance of a pixel, and a and b of the second mathematical formula are constants that determine a curvature of an initial curve of an exponential function.

In an embodiment, the harmonic mean may be expressed by a third mathematical formula $$\frac{\text{“}2xy\text{”}}{x+y},$$

where x is a luminance value of a first fitting function, and y is a luminance value of a second fitting function.

In an embodiment, the degradation compensator may include a memory, a calculator, and a compensation value generator. The memory may store degradation data in which variations of luminances of the pixels with respect to a gray level and a degradation time are stored as numerical values. The calculator may receive the image data including gray level information and image data information, select degradation data corresponding to the gray level information and the image data information among the degradation data stored in the memory, determine a parameter of each of first and second mathematical formulas based on the degradation data, generate each of the first and second fitting functions, and generate the compensation function. The compensation value generator may generate the compensation value based on the compensation function, and provide the compensation value to the controller.

In an embodiment, the light-emitting element may include an inorganic light-emitting diode.

In an embodiment, the inorganic light-emitting diode may be driven with a maximum luminance after a preset time without being driven with the maximum luminance upon initial driving.

In an embodiment, the light-emitting element may include an anode electrode, a cathode electrode, and an inorganic light-emitting layer disposed between the anode electrode and the cathode electrode. The inorganic light-emitting layer may emit a blue light.

In an embodiment, the pixel circuit may include at least one driving transistor, at least one switching transistor, and at least one storage capacitor.

In an embodiment, each of the pixels may further include a first quantum dot layer, a second quantum dot layer, and a scattering layer, which are disposed on the light-emitting element.

In an embodiment, the light-emitting element may emit a blue light.

In an embodiment, the first quantum dot layer may convert a blue light into a red light. The second quantum dot layer may convert the blue light into a green light. The scattering layer may transmit the blue light.

In an embodiment, the display device may further include a gate driver, an emission driver, and a power supply unit. The gate driver may generate a data write gate signal, a data initialization gate signal, and a light-emitting element initialization signal, and provide the data write gate signal, the data initialization gate signal, and the light-emitting element initialization signal to the pixel circuit. The emission driver may generate an emission signal, and provide the emission signal to the pixel circuit. The power supply unit may generate a first power supply voltage, a second power supply voltage, and an initialization voltage, and provide the first power supply voltage, the second power supply voltage, and the initialization voltage to the pixel circuit.

In an embodiment, the controller may control an operation of each of the data driver, the gate driver, and the emission driver.

In an embodiment of the invention, a method of driving a display device is provided as follows. Image data is received. Degradation data is selected based on the image data. Each of first and second fitting functions is generated by determining a parameter of each of first and second mathematical formulas. A compensation function is generated through a harmonic mean based on the first and second fitting functions. A compensation value is generated based on the compensation function, and input image data to which the compensation value is applied is generated. The input image data is converted into a data voltage. The data voltage is suppled to pixels.

In an embodiment, the first mathematical formula may be expressed as "$\exp[-(t/\tau)^{\beta}]$", where $\tau$ is a time desired for an initial luminance of a pixel to be degraded to a preset reference (decay time constant), $\beta$ is a parameter related to a degradation form of a pixel, which is a constant determined for each of pixels regardless of a gray level, and t is a degradation time of a pixel. The second mathematical formula may be expressed as "$a \cdot \exp[b \cdot t]+c$", where c is an initial luminance of a pixel, and a and b of the second mathematical formula are constants that determine a curvature of an initial curve of an exponential function. The harmonic mean may be expressed as $$\frac{\text{“}2xy\text{”}}{x+y},$$

where x is a luminance value of a first fitting function, and y is a luminance value of a second fitting function.

In an embodiment, the degradation compensator may include a memory, a calculator, and a compensation value generator. The memory may store degradation data in which variations of luminances of the pixels with respect to a gray level and a degradation time are stored as numerical values. The calculator may receive the image data including gray level information and image data information, select the degradation data corresponding to the gray level information and the image data information among the degradation data stored in the memory, determine the parameter of each of the first and second mathematical formulas based on the degradation data, generate each of the first and second fitting functions, and generate the compensation function. The compensation value generator may generate the compensation value based on the compensation function.

In an embodiment, each of the pixels may include a pixel circuit, a light-emitting element, a first quantum dot layer, a second quantum dot layer, and a scattering layer. The light-emitting element disposed on the pixel circuit may emit a blue light, and may include an inorganic light-emitting layer. The first quantum dot layer, the second quantum dot layer, and the scattering layer may be disposed on the light-emitting element.

Since the display device in the embodiments of the invention includes the degradation compensator capable of generating the compensation value by generating the compensation function through the harmonic mean of the first and second fitting functions, when the display device is driven, the display device may prevent a luminance deviation that occurs initially. Accordingly, display quality of the display device may be improved.

BRIEF DESCRIPTION OF THE DRAWINGS

Embodiments may be understood in more detail from the following description taken in conjunction with the accompanying drawings.

FIG. 3 is a view for describing an operation of the degradation compensator of FIG. 1.

DETAILED DESCRIPTION

Figure 1:
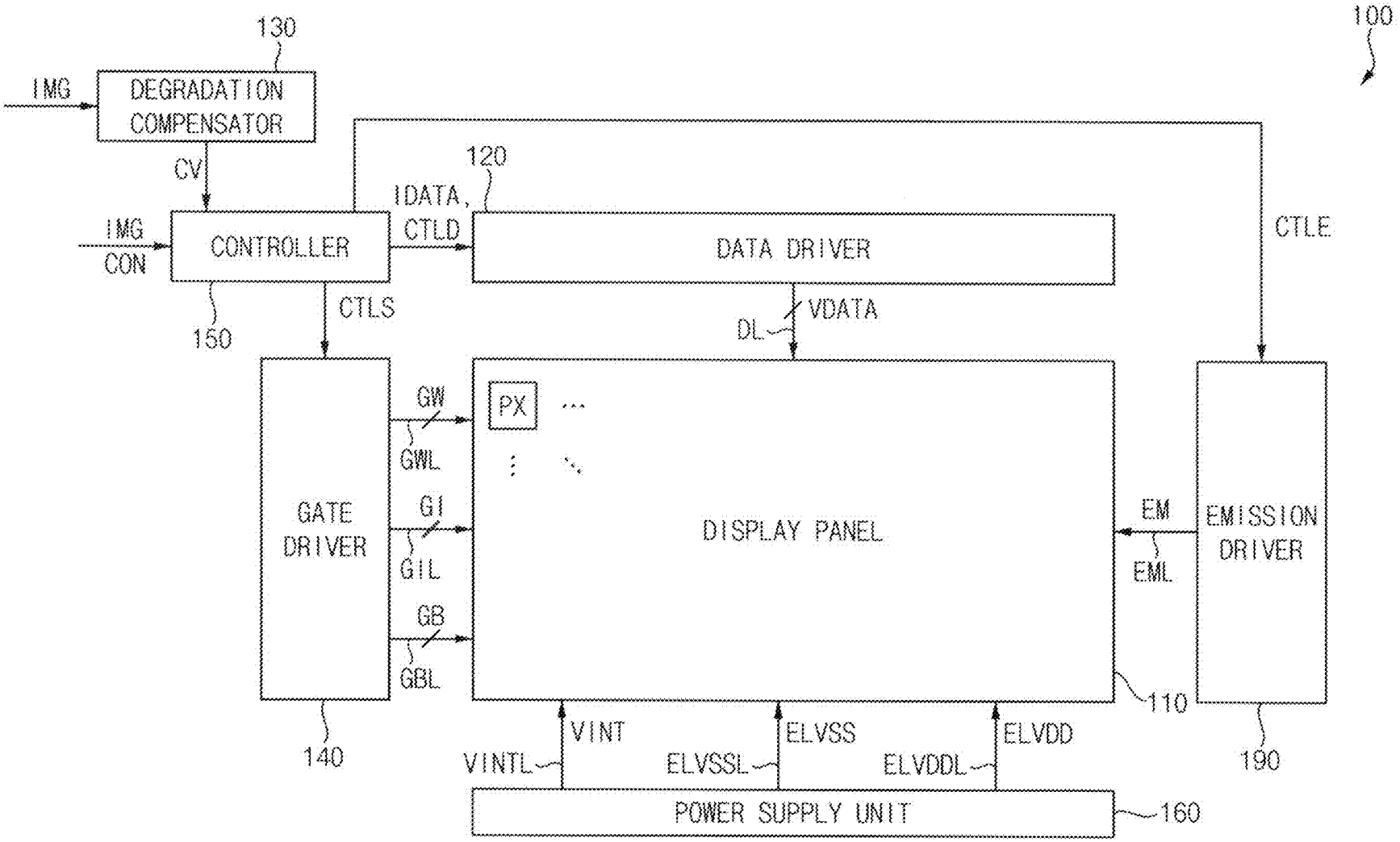
FIG. 1 is a block diagram showing an embodiment of a display device according to the invention.

Hereinafter, a display device and a method of driving a display device in embodiments of the invention will be described in detail with reference to the accompanying drawings. In the accompanying drawings, same or similar reference numerals refer to the same or similar elements.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term "about" can mean within one or more standard deviations, or within ±30%, 20%, 10%, 5% of the stated value, for example.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Figure 2:
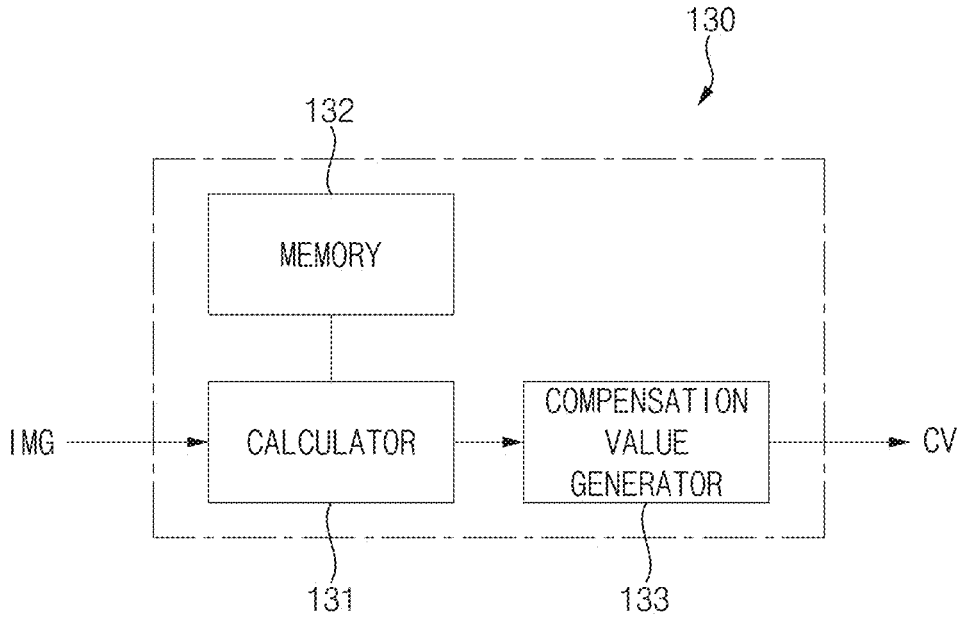
FIG. 2 is a block diagram for describing a degradation compensator included in the display device of FIG. 1.

FIG. 1 is a block diagram showing an embodiment of a display device in embodiments of the invention, FIG. 2 is a block diagram for describing a degradation compensator included in the display device of FIG. 1, and FIG. 3 is a view for describing an operation of the degradation compensator of FIG. 1. In an embodiment, a formula "$\exp[-(t/\tau)^{\beta}]$" of FIG. 3 will be defined as a first mathematical formula 310, a formula "$a \cdot \exp[b \cdot t]+c$" of FIG. 3 will be defined as a second mathematical formula 320, and a formula $$\frac{\text{“}2xy\text{”}}{x+y}$$

of FIG. 3 will be defined as a third mathematical formula 330, for example.

Referring to FIGS. 1, 2, and 3, a display device 100 may include a display panel 110 including a plurality of pixels PX, a controller 150, a data driver 120, a gate driver 140, an emission driver 190, a power supply unit 160, a degradation compensator 130, or the like. In this case, the degradation compensator 130 may include a calculator 131, a memory 132, and a compensation value generator 133.

The display panel 110 may include a plurality of data lines DL, a plurality of data write gate lines GWL, a plurality of data initialization gate lines GIL, a plurality of light-emitting element initialization lines GBL, a plurality of emission lines EML, a plurality of first power supply voltage lines ELVDDL, a plurality of second power supply voltage lines ELVSSL, a plurality of initialization voltage lines VINTL, and a plurality of pixels PX connected to the lines.

In an embodiment, each of the pixels PX may include at least two transistors, at least one capacitor, and a light-emitting element, and the display panel 110 may be a light-emitting display panel. In an embodiment, the display panel 110 may be a display panel of an inorganic light-emitting display device ("ILED"). In other embodiments, the display panel 110 may include a display panel of an organic light-emitting display device ("OLED"), a display panel of a quantum dot display device ("QDD"), a display panel of a liquid crystal display device ("LCD"), a display panel of a field emission display device ("FED"), a display panel of a plasma display device ("PDP"), or a display panel of an electrophoretic display device ("EPD").

The controller 150 (e.g., a timing controller ("T-CON") may receive image data IMG and an input control signal CON from an external host processor (e.g., an application processor ("AP"), a graphic processing unit ("GPU"), or a graphic card). The image data IMG may be RGB image data including red image data, green image data, and blue image data. In addition, the image data IMG may include information on a driving frequency and a gray level. The input control signal CON may include a vertical synchronization signal, a horizontal synchronization signal, an input data enable signal, a master clock signal, or the like, but the invention is not limited thereto.

The controller 150 may convert the image data IMG into input image data IDATA by applying an algorithm (e.g., dynamic capacitance compensation ("DCC"), etc.) for correcting image quality to the image data IMG supplied from the external host processor. In some embodiments, when the controller 150 does not include an algorithm for improving image quality, the image data IMG may be output as the input image data IDATA. In an embodiment, the controller 150 may convert the image data IMG into the input image data IDATA by applying a compensation value CV generated by the degradation compensator 130, and the controller 150 may provide the input image data IDATA to which the compensation value CV is applied to the data driver 120.

The controller 150 may generate a data control signal CTLD for controlling an operation of the data driver 120, a gate control signal CTLS for controlling an operation of the gate driver 140, and an emission control signal CTLE for controlling an operation of the emission driver 190 based on the input control signal CON. In an embodiment, the gate control signal CTLS may include a vertical start signal, gate clock signals, or the like, and the data control signal CTLD may include a horizontal start signal, a data clock signal, or the like, for example.

The gate driver 140 may generate data write gate signals GW, data initialization gate signals GI, and light-emitting element initialization signals GB based on the gate control signal CTLS received from the controller 150. The gate driver 140 may output the data write gate signals GW, the data initialization gate signals GI, and the light-emitting element initialization signals GB to the pixels PX connected to the data write gate lines GWL, the data initialization gate lines GIL, and the light-emitting element initialization lines GBL.

The emission driver 190 may generate emission signals EM based on the emission control signal CTLE received from the controller 150. The emission driver 190 may output the emission signals EM to the pixels PX connected to the emission lines EML.

The power supply unit 160 may generate an initialization voltage VINT, a first power supply voltage ELVDD, and a second power supply voltage ELVSS, and provide the initialization voltage VINT, the first power supply voltage ELVDD, and the second power supply voltage ELVSS to the pixels PX through the initialization voltage line VINTL, the first power supply voltage line ELVDDL, and the second power supply voltage line ELVSSL.

The data driver 120 may receive the data control signal CTLD and the input image data IDATA from the controller 150. In this case, the input image data IDATA may be a signal to which the compensation value CV generated by the degradation compensator 130 is applied. The data driver 120 may convert digital input image data IDATA into an analog data voltage by a gamma reference voltage generated by a gamma reference voltage generator (not shown). In this case, the analog data voltage obtained by the conversion will be defined as a data voltage VDATA. The data driver 120 may output data voltages VDATA to the pixels PX connected to the data lines DL based on the data control signal CTLD. In other embodiments, the data driver 120 and the controller 150 may be implemented as a single integrated circuit ("IC"), and such an IC may be also referred to as a timing controller-embedded data driver ("TED").

The calculator 131 of the degradation compensator 130 may receive the image data IMG, and may receive image data information and gray level information from the image data IMG. The calculator 131 may select degradation data corresponding to the gray level information and the image data information among degradation data stored in the memory 132. In this case, the degradation data may be data in which variations of luminances of red, green, and blue pixels with respect to a driving time (or a degradation time) for each current density (or for each gray level) of each the pixels are stored as numerical values. The degradation data may be stored in the memory 132 through actual measurement in an inspection operation during a manufacturing process of the display device 100.

The calculator 131 may determine a parameter of each of the first and second mathematical formulas 310 and 320 based on the degradation data, and may generate first and second fitting functions. In this case, $\tau$ of the first mathematical formula 310 may be a time desired for an initial luminance of a pixel to be degraded to a preset reference (decay time constant). In an embodiment, $\tau$ may be a time desired for the initial luminance of the pixel to be degraded from about 100% to about 80%, for example. Further, $\beta$ of the first mathematical formula 310 may be a parameter related to a degradation form of a pixel, which is a constant determined for each of pixels regardless of a gray level. Further, t of the first mathematical formula 310 may be a degradation time of a pixel. In addition, c of the second mathematical formula 320 may be an initial luminance of a pixel, and a and b of the second mathematical formula 320 may be constants that determine a curvature of an initial curve of an exponential function. Further, t of the second mathematical formula 320 may be a degradation time of a pixel. In other words, the first fitting function representing a variation of a luminance of the pixel with respect to a degradation time of the pixel may be determined through the first mathematical formula 310, and the second fitting function representing a variation of a luminance of the pixel with respect to a degradation time of the pixel may be determined through the second mathematical formula 320. In this case, the first fitting function may correspond to an exponential graph (or an exponential function) in which a luminance value of the pixel with respect to a degradation time of the pixel is gradually decreased, and the second fitting function may correspond to an exponential graph (or an exponential function) in which a luminance value of the pixel is gradually decreased after the luminance value of the pixel is increased during an initial time of the pixel. A compensation function may be generated through a harmonic mean (i.e., the third mathematical formula 330) of the first fitting function and the second fitting function. In this case, the harmonic mean refers to a mean of a reciprocal, in which a mean value may be close to a smaller luminance value between a luminance value of the first fitting function (e.g., x of the third mathematical formula 330) and a luminance value of the second fitting function (e.g., y of the third mathematical formula 330).

The compensation value generator 133 may generate the compensation value CV based on the compensation function, and the compensation value generator 133 may provide the compensation value CV to the controller 150.

In other embodiments, the degradation compensator 130 and the controller 150 may be implemented as a single IC.

Since the display device 100 in the embodiments of the invention includes the degradation compensator 130 capable of generating the compensation value CV by generating the compensation function through the harmonic mean of the first and second fitting functions, when the display device 100 is driven, the display device 100 may prevent a luminance deviation that occurs initially. Accordingly, display quality of the display device 100 may be improved.

Figure 4:
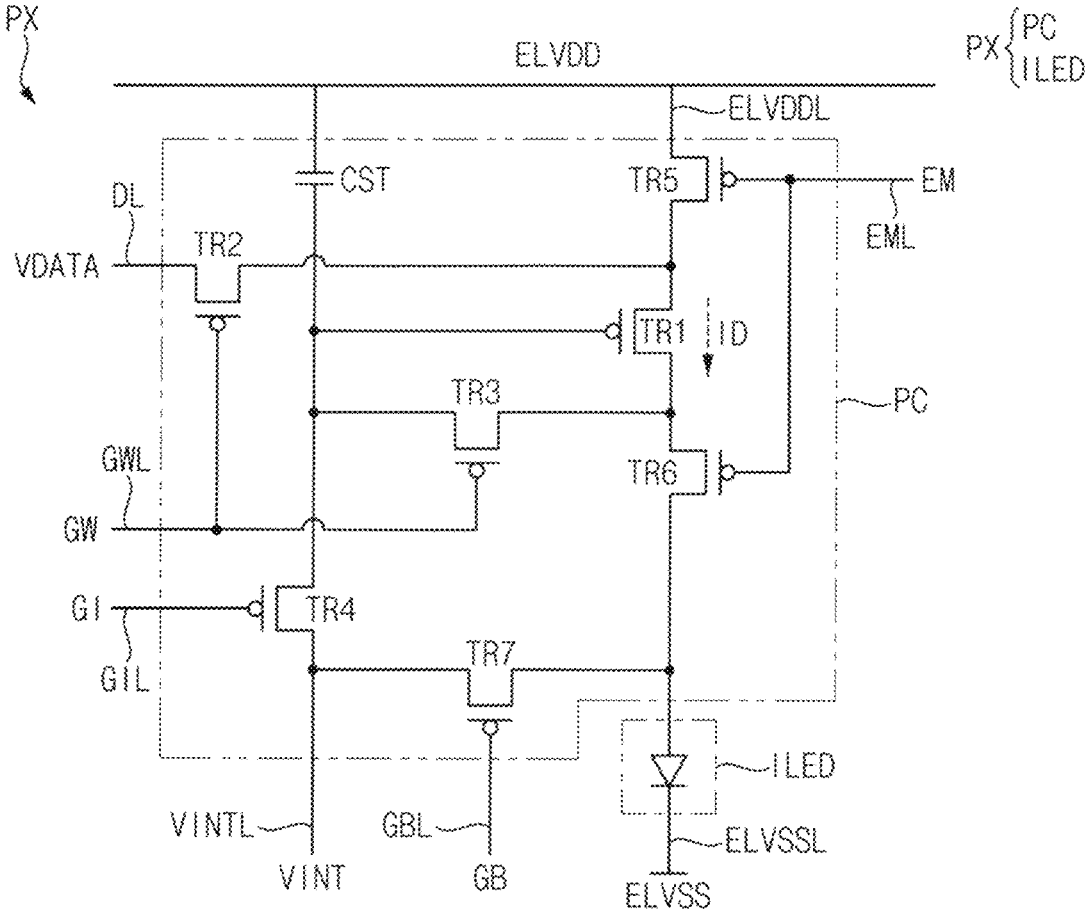
FIG. 4 is a circuit diagram showing a pixel included in the display device of FIG. 1.

FIG. 4 is a circuit diagram showing a pixel included in the display device of FIG. 1.

Referring to FIG. 4, the display device 100 may include a pixel PX, and the pixel PX may include a pixel circuit PC and an inorganic light-emitting diode ILED. In this case, the pixel circuit PC may include first to seventh transistors TR1, TR2, TR3, TR4, TR5, TR6, and TR7, a storage capacitor CST, or the like. In addition, the pixel circuit PC or the inorganic light-emitting diode ILED may be connected to the first power supply voltage line ELVDDL, the second power supply voltage line ELVSSL, the initialization voltage line VINTL, the light-emitting element initialization line GBL, the data line DL, the data write gate line GWL, the data initialization gate line GIL, the emission line EML, or the like. The first transistor TR1 may correspond to a driving transistor, and the second to seventh transistors TR2, TR3, TR4, TR5, TR6, and TR7 may correspond to switching transistors. Each of the first to seventh transistors TR1, TR2, TR3, TR4, TR5, TR6, and TR7 may include a first terminal, a second terminal, and a gate terminal. In an embodiment, the first terminal may be a source terminal, and the second terminal may be a drain terminal. In some embodiments, the first terminal may be a drain terminal, and the second terminal may be a source terminal.

In an embodiment, each of the first to seventh transistors TR1, TR2, TR3, TR4, TR5, TR6, and TR7 may be a P-type metal oxide semiconductor ("PMOS") transistor, and may have a channel including polysilicon.

In other embodiments, each of the first, second, fifth, sixth, and seventh transistors TR1, TR2, TR5, TR6, and TR7 may be a PMOS transistor, and may have a channel including polysilicon. In addition, each of the third and fourth transistors TR3 and TR4 may be an N-type metal oxide semiconductor ("NMOS") transistor, and may have a channel including a metal oxide semiconductor.

The inorganic light-emitting diode ILED may output a light based on a driving current ID. The inorganic light-emitting diode ILED may include a first terminal and a second terminal. In an embodiment, the first terminal of the inorganic light-emitting diode ILED may receive the first power supply voltage ELVDD, and the second terminal of the inorganic light-emitting diode ILED may receive the second power supply voltage ELVSS. In this case, the first power supply voltage ELVDD and the second power supply voltage ELVSS may be provided from the power supply unit 160 through the first power supply voltage line ELVDDL and the second power supply voltage line ELVSSL, respectively. In an embodiment, the first terminal of the inorganic light-emitting diode ILED may be an anode terminal, and the second terminal of the inorganic light-emitting diode ILED may be a cathode terminal, for example. In some embodiments, the first terminal of the inorganic light-emitting diode ILED may be a cathode terminal, and the second terminal of the inorganic light-emitting diode ILED may be an anode terminal.

The first power supply voltage ELVDD may be applied to the first terminal of the first transistor TR1. The second terminal of the first transistor TR1 may be connected to the first terminal of the inorganic light-emitting diode ILED. The initialization voltage VINT may be applied to the gate terminal of the first transistor TR1. In this case, the initialization voltage VINT may be provided from the power supply unit 160 through the initialization voltage line VINTL.

The first transistor TR1 may generate the driving current ID. In an embodiment, the first transistor TR1 may operate in a saturation region. In this case, the first transistor TR1 may generate the driving current ID based on a voltage difference between the gate terminal and the first terminal (e.g., source terminal) of the first transistor TR1. In addition, gray levels may be expressed based on a magnitude of the driving current ID supplied to the inorganic light-emitting diode ILED. In some embodiments, the first transistor TR1 may operate in a linear region. In this case, the gray levels may be expressed based on a sum of a time during which the driving current is supplied to the inorganic light-emitting diode ILED within one frame.

The gate terminal of the second transistor TR2 may receive the data write gate signal GW. In this case, the data write gate signal GW may be provided from the gate driver 140 through the data write gate line GWL. The first terminal of the second transistor TR2 may receive the data voltage VDATA. In this case, the data voltage VDATA may be provided from the data driver 120 through the data line DL. The second terminal of the second transistor TR2 may be connected to the first terminal of the first transistor TR1. The second transistor TR2 may supply the data voltage VDATA to the first terminal of the first transistor TR1 during an activation period of the data write gate signal GW. In this case, the second transistor TR2 may operate in a linear region.

The gate terminal of the third transistor TR3 may receive the data write gate signal GW. In this case, the data write gate signal GW may be provided from the gate driver 140 through the data write gate line GWL. The first terminal of the third transistor TR3 may be connected to the gate terminal of the first transistor TR1. The second terminal of the third transistor TR3 may be connected to the second terminal of the first transistor TR1. In other words, the third transistor TR3 may be connected between the gate terminal of the first transistor TR1 and the second terminal of the first transistor TR1.

The third transistor TR3 may connect the gate terminal of the first transistor TR1 to the second terminal of the first transistor TR1 during the activation period of the data write gate signal GW. In this case, the third transistor TR3 may operate in a linear region. In other words, the third transistor TR3 may diode-connect the first transistor TR1 during the activation period of the data write gate signal GW. Since the first transistor TR1 is diode-connected, a voltage difference corresponding to a threshold voltage of the first transistor TR1 may occur between the first terminal of the first transistor TR1 and the gate terminal of the first transistor TR1. In this case, the threshold voltage may have a negative value. As a result, a voltage obtained by summing up the data voltage VDATA supplied to the first terminal of the first transistor TR1 and the voltage difference (i.e., the threshold voltage) may be supplied to the gate terminal of the first transistor TR1 during the activation period of the data write gate signal GW. In other words, the data voltage VDATA may be compensated for by the threshold voltage of the first transistor TR1, and the compensated data voltage VDATA may be supplied to the gate terminal of the first transistor TR1.

The gate terminal of the fourth transistor TR4 may receive the data initialization gate signal GI. In this case, the data initialization gate signal GI may be provided from the gate driver 140 through the data initialization gate line GIL. The first terminal of the fourth transistor TR4 may be connected to the initialization voltage line VINTL, and may receive the initialization voltage VINT. The second terminal of the fourth transistor TR4 may be connected to the gate terminal of the first transistor TR1 (or the first terminal of the third transistor TR3).

The fourth transistor TR4 may supply the initialization voltage VINT to the gate terminal of the first transistor TR1 during an activation period of the data initialization gate signal GI. In this case, the fourth transistor TR4 may operate in a linear region. In other words, the fourth transistor TR4 may initialize the gate terminal of the first transistor TR1 to the initialization voltage VINT during the activation period of the data initialization gate signal GI. In an embodiment, the initialization voltage VINT may have a voltage level that is sufficiently lower than a voltage level of the data voltage VDATA maintained by the storage capacitor CST in a previous frame, and the initialization voltage VINT may be supplied to the gate terminal of the first transistor TR1. In other embodiments, the initialization voltage VINT may have a voltage level that is sufficiently higher than the voltage level of the data voltage VDATA maintained by the storage capacitor CST in the previous frame, and the initialization voltage VINT may be supplied to the gate terminal of the first transistor TR1. In some embodiments, the data initialization gate signal GI may be substantially the same as the data write gate signal GW of one horizontal time before. In an embodiment, the data initialization gate signal GI supplied to pixels PX in an $n^{th}$ row (where n is an integer that is greater than or equal to 2) among the pixels PX included in the display device 100 may be a signal that is substantially the same as the data write gate signal GW supplied to pixels PX in an $(n-1)^{th}$ row among the pixels PX, for example. In other words, an activated data write gate signal GW may be supplied to the pixels PX in the $(n-1)^{th}$ row among the pixels PX, so that an activated data initialization gate signal GI may be supplied to the pixels PX in the $n^{th}$ row among the pixels PX. As a result, the data voltage VDATA may be supplied to the pixels PX in the $(n-1)^{th}$ row among the pixels PX, and simultaneously, the gate terminal of the first transistor TR1 included in the pixels PX in the $n^{th}$ row among the pixels PX may be initialized to the initialization voltage VINT.

The gate terminal of the fifth transistor TR5 may receive the emission signal EM. In this case, the emission signal EM may be provided from the emission driver 190 through the emission line EML. The first terminal of the fifth transistor TR5 may receive the first power supply voltage ELVDD. The second terminal of the fifth transistor TR5 may be connected to the first terminal of the first transistor TR1. The fifth transistor TR5 may supply the first power supply voltage ELVDD to the first terminal of the first transistor TR1 during an activation period of the emission signal EM. On the contrary, the fifth transistor TR5 may cut off the supply of the first power supply voltage ELVDD during an inactivation period of the emission signal EM. In this case, the fifth transistor TR5 may operate in a linear region. Since the fifth transistor TR5 supplies the first power supply voltage ELVDD to the first terminal of the first transistor TR1 during the activation period of the emission signal EM, the first transistor TR1 may generate the driving current ID. In addition, since the fifth transistor TR5 cuts off the supply of the first power supply voltage ELVDD during the inactivation period of the emission signal EM, the data voltage VDATA supplied to the first terminal of the first transistor TR1 may be supplied to the gate terminal of the first transistor TR1.

The gate terminal of the sixth transistor TR6 may receive the emission signal EM. The first terminal of the sixth transistor TR6 may be connected to the second terminal of the first transistor TR1. The second terminal of the sixth transistor TR6 may be connected to the first terminal of the inorganic light-emitting diode ILED. The sixth transistor TR6 may supply the driving current ID generated by the first transistor TR1 to the inorganic light-emitting diode ILED during the activation period of the emission signal EM. In this case, the sixth transistor TR6 may operate in a linear region. In other words, since the sixth transistor TR6 supplies the driving current ID generated by the first transistor TR1 to the inorganic light-emitting diode ILED during the activation period of the emission signal EM, the inorganic light-emitting diode ILED may output the light. In addition, since the sixth transistor TR6 electrically separates the first transistor TR1 and the inorganic light-emitting diode ILED from each other during the inactivation period of the emission signal EM, the compensated data voltage VDATA supplied to the second terminal of the first transistor TR1 may be supplied to the gate terminal of the first transistor TR1.

The gate terminal of the seventh transistor TR7 may receive the light-emitting element initialization signal GB. The first terminal of the seventh transistor TR7 may receive the initialization voltage VINT. The second terminal of the seventh transistor TR7 may be connected to the first terminal of the inorganic light-emitting diode ILED. In other words, the seventh transistor TR7 may be connected between the initialization voltage line VINTL and the first terminal of the inorganic light-emitting diode ILED. The seventh transistor TR7 may supply the initialization voltage VINT to the first terminal of the inorganic light-emitting diode ILED during an activation period of the light-emitting element initialization signal GB. In this case, the seventh transistor TR7 may operate in a linear region. In other words, the seventh transistor TR7 may initialize the first terminal of the inorganic light-emitting diode ILED to the initialization voltage VINT during the activation period of the light-emitting element initialization signal GB.

The storage capacitor CST may be connected between the first power supply voltage line ELVDDL and the gate terminal of the first transistor TR1. The storage capacitor CST may include a first terminal and a second terminal. In an embodiment, the first terminal of the storage capacitor CST may receive the first power supply voltage ELVDD, and the second terminal of the storage capacitor CST may be connected to the gate terminal of the first transistor TR1, for example. The storage capacitor CST may maintain a voltage level of the gate terminal of the first transistor TR1 during an inactivation period of the data write gate signal GW. The inactivation period of the data write gate signal GW may include the activation period of the emission signal EM, and the driving current ID generated by the first transistor TR1 may be supplied to the inorganic light-emitting diode ILED during the activation period of the emission signal EM. Therefore, the driving current ID generated by the first transistor TR1 may be supplied to the inorganic light-emitting diode ILED based on the voltage level maintained by the storage capacitor CST.

However, although the pixel circuit PC according to the invention has been described as including one driving transistor, six switching transistors, and one storage capacitor, for example, the configuration of the invention is not limited thereto. In an embodiment, the pixel circuit PC may have a configuration including at least one driving transistor, at least one switching transistor, and at least one storage capacitor, for example.

In addition, although the light-emitting element included in the pixel PX according to the invention has been described as including the inorganic light-emitting diode ILED, the configuration of the invention is not limited thereto. In an embodiment, the light-emitting element may include a quantum dot ("QD") light-emitting element, an organic light-emitting diode, or the like, for example.

Figure 5:
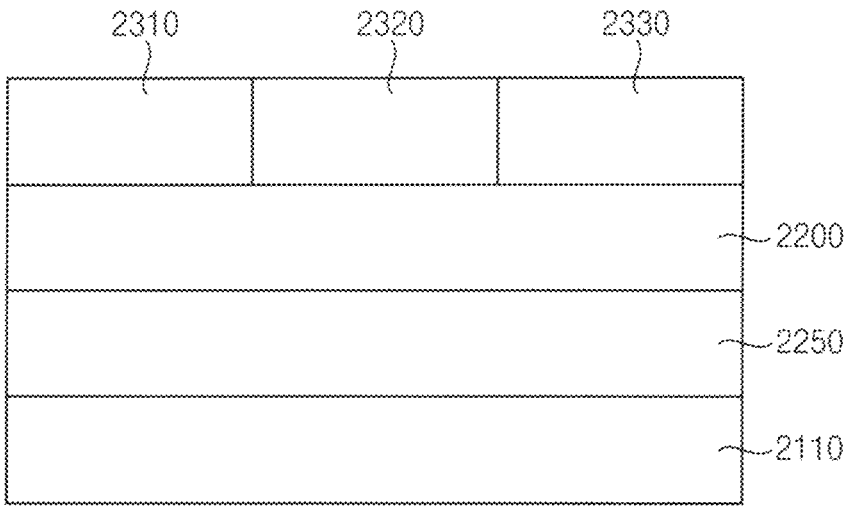
FIG. 5 is a cross-sectional view showing the display device of FIG. 1.

FIG. 5 is a cross-sectional view showing the display device of FIG. 1.

Referring to FIG. 5, the display device 100 may include a substrate 2110, a pixel circuit 2250, an inorganic light-emitting diode 2200, a first quantum dot layer 2310, a second quantum dot layer 2320, a scattering layer 2330, or the like.

The substrate 2110 may include a transparent or opaque material. In an embodiment, the substrate 2110 may be a rigid substrate such as a quartz substrate, a synthetic quartz substrate, a calcium fluoride substrate, a fluorine-doped quartz substrate (F-doped quartz substrate), a soda lime glass substrate, or a non-alkali glass substrate, for example. In some embodiments, the substrate 2110 may be configured as a flexible transparent resin substrate. In an embodiment, an embodiment of the transparent resin substrate that may be used as the substrate 2110 may include a polyimide substrate, for example. In this case, the polyimide substrate may have a stacked structure including a first polyimide layer, a barrier film layer, a second polyimide layer, or the like.

The pixel circuit 2250 may be disposed on the substrate 2110. The pixel circuit 2250 may include a semiconductor element, a capacitor, an insulating layer, or the like. In an embodiment, configurations of the semiconductor element and the capacitor may be the same as the configurations thereof in the pixel circuit PC of FIG. 4, for example.

The inorganic light-emitting diode 2200 may be disposed on the pixel circuit 2250. The inorganic light-emitting diode 2200 may include an anode electrode, an inorganic light-emitting layer, and a cathode electrode. In this case, the inorganic light-emitting layer may be disposed between the anode electrode and the cathode electrode. The inorganic light-emitting layer may emit various color lights according to a material of an active material layer. In an embodiment, the inorganic light-emitting layer may emit a blue light. The inorganic light-emitting diode 2200 may correspond to a fine light-emitting element, and the inorganic light-emitting diode 2200 may be a nanostructure that approximately has a nanoscale size. Each of the anode electrode and the cathode electrode may include a metal, an alloy, metal nitride, conductive metal oxide, a transparent conductive material, or the like. In an embodiment, the inorganic light-emitting diode 2200 may be the same as the inorganic light-emitting diode ILED of FIG. 4, for example.

The first quantum dot layer 2310, the second quantum dot layer 2320, and the scattering layer 2330 may be disposed on the inorganic light-emitting diode 2200.

The first quantum dot layer 2310 may convert a blue light into a red light. In an embodiment, the first quantum dot layer 2310 may include a plurality of quantum dots which absorb the blue light and emit the red light, for example.

The second quantum dot layer 2320 may convert a blue light into a green light. In an embodiment, the second quantum dot layer 2320 may include a plurality of quantum dots which absorb the blue light and emit the green light, for example.

In an embodiment, the quantum dots included in each of the first and second quantum dot layers 2310 and 2320 may include one nanocrystal among a silicon (Si)-based nanocrystal, a group II-VI-based compound semiconductor nanocrystal, a group III-V-based compound semiconductor nanocrystal, a group IV-VI-based compound semiconductor nanocrystal, and a combination thereof. In an embodiment, the group II-VI-based compound semiconductor nanocrystal may include at least one of CdS, CdSe, CdTe, ZnS, ZnSe, ZnTe, HgS, HgSe, HgTe, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, HgZnTe, CdZnSeS, CdZnSeTe, CdZnSTe, CdHgSeS, CdHgSeTe, CdHgSTe, HgZnSeS, HgZnSeTe, and HgZnSTe. In an embodiment, the group III-V-based compound semiconductor nanocrystal may include at least one of GaN, GaP, GaAs, AlN, AlP, AlAs, InN, InP, InAs, GaNP, GaNAs, GaPAs, AlNP, AlNAs, AlPAs, InNP, InNAs, InPAs, GaAlNP, GaAlNAs, GaAlPAs, GaInNP, GaInNAs, GaInPAs, InAlNP, InAlNAs, and InAlPAs. In an embodiment, the group IV-VI-based compound semiconductor nanocrystal may be SbTe.

Even when the quantum dots included in each of the first and second quantum dot layers 2310 and 2320 include the same material as each other, an emission wavelength may vary according to a size of the quantum dot. In an embodiment, as the size of the quantum dot becomes smaller, a light having a shorter wavelength may be emitted, for example. Therefore, a light within a desired visible light region may be emitted by adjusting the size of the quantum dot included in each of the first and second quantum dot layers 2310 and 2320.

The scattering layer 2330 may transmit a blue light. In an embodiment, the scattering layer 2330 may include a scattering material that intactly emits a blue light. In other words, the scattering layer 2330 may not include the quantum dots, for example. In some embodiments, each of the first and second quantum dot layers 2310 and 2320 may further include the scattering material.

In an embodiment, the scattering layer 2330 may include TiO, ZrO, $AlO_3$, $In_2O_3$, ZnO, $SnO_2$, $Sb_2O_3$, IT, or the like. However, a material of the scattering layer 2330 is not limited thereto, and may be variously modified into any material that scatters a blue light without converting the blue light.

In some embodiments, red, green, and blue color filters may be disposed on the first quantum dot layer 2310, the second quantum dot layer 2320, and the scattering layer 2330, respectively.

In an embodiment, the pixel circuit 2250, the inorganic light-emitting diode 2200, and the first quantum dot layer 2310 will be defined as a first pixel, the pixel circuit 2250, the inorganic light-emitting diode 2200, and the second quantum dot layer 2320 will be defined as a second pixel, and the pixel circuit 2250, the inorganic light-emitting diode 2200, and the scattering layer 2330 will be defined as a third pixel.

The inorganic light-emitting diode 2200 which emits the blue light may have a relatively slow degradation rate. On the contrary, the first quantum dot layer 2310, the second quantum dot layer 2320, and the scattering layer 2330 including the quantum dots may be degraded at a relatively rapid rate. In an embodiment, since the quantum dots included in each of the first quantum dot layer 2310 and the second quantum dot layer 2320 collide with photons emitted from the inorganic light-emitting diode 2200, the first and second quantum dot layers 2310 and 2320 may be degraded at a relatively rapid rate as the driving time of the display device 100 increases, for example. The first and second quantum dot layers 2310 and 2320 including the quantum dots may be degraded relatively faster than the scattering layer 2330 including the scattering material. As a result, degradation of the first to third pixels included in the display device 100 may be determined by the first and second quantum dot layers 2310 and 2320 and the scattering layer 2330 rather than the inorganic light-emitting diode 2200. In addition, rates at which the first to third pixels are degraded may be different from each other.

Figure 6:
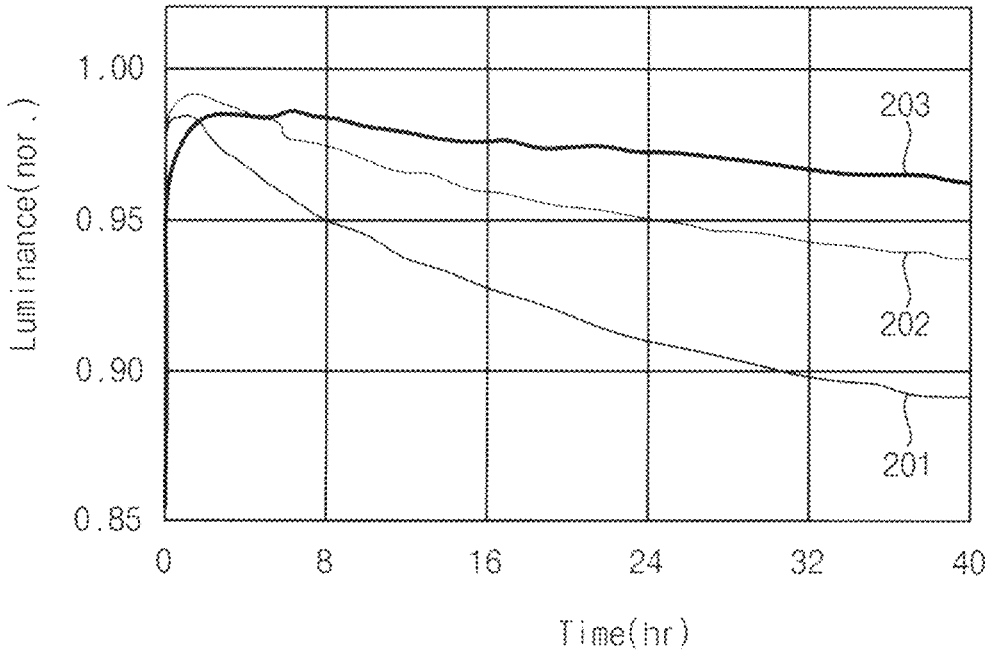
FIG. 6 is a graph showing a variation of a luminance with respect to a driving time for each current density provided to a pixel when the display device of FIG. 1 is driven.

FIG. 6 is a graph showing a variation of a luminance with respect to a driving time for each current density provided to a pixel when the display device of FIG. 1 is driven. In an embodiment, a horizontal axis of FIG. 6 may represent a degradation time of a pixel in terms of an hour, and a vertical axis of FIG. 6 may represent a normalized luminance of the pixel, for example.

Referring to FIGS. 5 and 6, a luminance of a white light was measured by driving all of the first to third pixels (e.g., a red pixel, a green pixel, and a blue pixel) included in the display device 100.

In an embodiment, a first graph 201 may be a graph showing variations of luminances of the first to third pixels with respect to a degradation time of the first to third pixels when a current of approximately 1.8 microampere is applied to the first to third pixels, and a current density value applied to the first to third pixels may correspond to a high gray level, for example. In this case, a maximum luminance of the first to third pixels in the first graph 201 may be reached after approximately one hour has elapsed.

In addition, a second graph 202 may be a graph showing variations of luminances of the first to third pixels with respect to a degradation time of the first to third pixels when a current of approximately 0.9 microampere is applied to the first to third pixels, and a current density value applied to the first to third pixels may correspond to a middle gray level. In this case, a maximum luminance of the first to third pixels in the second graph 202 may be reached after approximately two hours have elapsed.

Moreover, a third graph 203 may be a graph showing variations of luminances of the first to third pixels with respect to a degradation time of the first to third pixels when a current of approximately 0.45 microampere is applied to the first to third pixels, and a current density value applied to the first to third pixels may correspond to a low gray level. In this case, a maximum luminance of the first to third pixels in the third graph 203 may be reached after approximately 8 hours have elapsed.

As described above, the first to third pixels of the display device 100 may include the inorganic light-emitting diodes, and due to characteristics of the inorganic light-emitting diode, the maximum luminance of the first to third pixels may not be immediately reached upon initial driving of the first to third pixels, but the maximum luminance of the first to third pixels may be reached after a predetermined time has elapsed for each gray level. In this case, a luminance difference may occur according to a degradation time of each of the pixels, and the luminance difference may be recognized by a user of the display device 100. In an embodiment, according to the third graph 203, when a blue light is emitted from pixels, which are disposed in a first area of a front surface (e.g., a surface on which an image is displayed) of the display device 100 and degraded for 48 hours, and a blue light is emitted from pixels, which are disposed in a second area that is adjacent to the first area and degraded for 0 hour, the pixels disposed in the second area may not immediately reach the maximum luminance upon the initial driving, for example, so that a luminance difference may occur between the pixels disposed in the second area and the pixels disposed in the first area.

Figure 7:
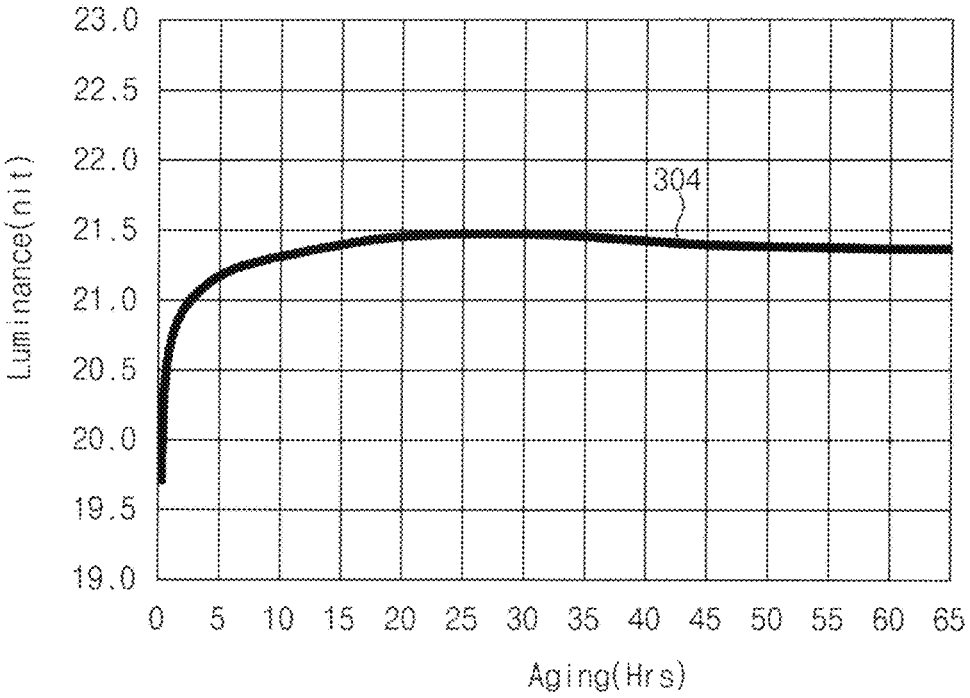
FIG. 7 is a graph showing a variation of a luminance with respect to a driving time of a blue light-emitting element when the pixel of FIG. 4 is driven with a low gray level.

FIG. 7 is a graph showing a variation of a luminance with respect to a driving time of a blue light-emitting element when the pixel of FIG. 4 is driven with a low gray level. In an embodiment, a horizontal axis of FIG. 7 may represent a degradation time of a pixel, and a vertical axis of FIG. 7 may represent a luminance of the pixel, for example.

Referring to FIGS. 5, 6, and 7, since the first to third pixels included in the display device 100 include the first and second quantum dot layers 2310 and 2320 and the scattering layer 2330, the degradation may occur according to the driving time. In addition, since the first to third pixels included in the display device 100 include the inorganic light-emitting diode 2200, due to the diode characteristics, the maximum luminance of the first to third pixels may not be immediately reached upon the initial driving of the first to third pixels, but the maximum luminance may be reached after a predetermined time has elapsed for each gray level.

A graph 304 of FIG. 7 may represent a variation of a luminance of the third pixel with respect to a driving time of the third pixel when the third pixel is driven with a low gray level. As shown in the graph 304 of FIG. 7, the luminance of the third pixel may not immediately reach the maximum luminance upon the initial driving, but may reach the maximum luminance after a predetermined time has elapsed (e.g., after approximately 32 hours). In addition, after the third pixel reaches the maximum luminance, the luminance may be gradually decreased.

In an embodiment, according to a conventional display device, in order to compensate for a luminance deviation of a pixel caused by degradation of the pixel, only a gradually decreasing exponential graph has been used as a compensation function, for example. However, when the compensation function is applied to the conventional display device including an inorganic light-emitting diode, due to characteristics of the inorganic light-emitting diode, the pixel may not immediately reach a maximum luminance upon initial driving, so that a luminance deviation may occur during the initial driving. According to the conventional display device including the inorganic light-emitting diode, luminance compensation or accurate compensation may not be performed upon the initial driving, so that display quality of the display device may be degraded.

Referring back to FIGS. 1, 2, 3, and 7, according to the display device 100, the memory 132 of the degradation compensator 130 may store a variation of a luminance with respect to a driving time (or a degradation time) for each current density (or for each gray level) of each of red, green, and blue light-emitting elements as a numerical value. In other words, information corresponding to the graph 304 may be stored in the memory 132. In an embodiment, the gray level information stored in the memory 132 may be divided into a low gray level, a middle gray level, and a high gray level (i.e., three gray levels in total), or the gray level information stored in the memory 132 may be divided into current density ratios of about 100%, about 50%, about 20%, and about 12.5% (i.e., four current density ratios in total). In some embodiments, the gray level information stored in the memory 132 may be divided into the current density ratios of about 100%, about 50%, about 20%, and about 12.5% (i.e., four current density ratios in total), and gray levels corresponding to a ratio between the above ratios may be applied through interpolation or extrapolation. In this case, relatively accurate degradation data may be obtained.

In an embodiment, the calculator 131 may receive the image data IMG to receive the image data information and the gray level information, for example. The calculator 131 may select the degradation data corresponding to the gray level information and the image data information among the degradation data stored in the memory 132.

Figure 8:
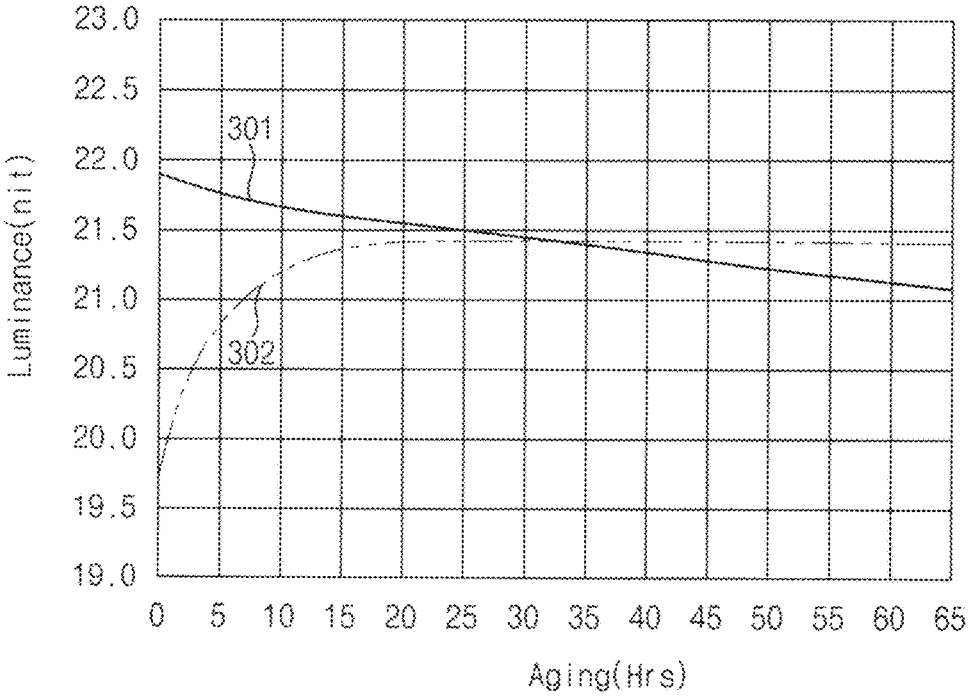
FIG. 8 is a view showing fitting function graphs of first and second mathematical formulas having parameters that are determined to implement the graph of FIG. 7.

FIG. 8 is a view showing fitting function graphs of first and second mathematical formulas having parameters that are determined to implement the graph of FIG. 7. In an embodiment, a horizontal axis of FIG. 8 may represent a degradation time, and a vertical axis of FIG. 8 may represent a luminance, for example.

Referring to FIGS. 2, 3, 7, and 8, the calculator 131 may determine a parameter of each of the first and second mathematical formulas 310 and 320 based on the degradation data obtained from the memory 132. In this case, $\tau$ of the first mathematical formula 310 may be a time desired for an initial luminance to be degraded to a preset reference (decay time constant). In an embodiment, when the initial luminance is 100, $\tau$ may be a time desired for the initial luminance to be degraded to about 80%, for example. Further, $\beta$ of the first mathematical formula 310 may be a parameter related to a degradation form, which is a constant determined for each of light-emitting elements regardless of a gray level. Further, t of the first mathematical formula 310 may be a degradation time. In addition, c of the second mathematical formula 320 may be an initial luminance, and a and b of the second mathematical formula 320 may be constants that determine a curvature of an initial curve of an exponential function. Further, t of the second mathematical formula 320 may be a degradation time.

In other words, a first fitting function 301 representing a variation of a luminance with respect to a degradation time may be determined through the first mathematical formula 310, and a second fitting function 302 representing a variation of a luminance with respect to a degradation time may be determined through the second mathematical formula 320. In this case, the first fitting function 301 may correspond to an exponential graph in which a luminance value is gradually decreased according to a time, and the second fitting function 302 may correspond to an exponential graph in which a luminance value is gradually decreased after the luminance value is increased during an initial time.

Figure 9:
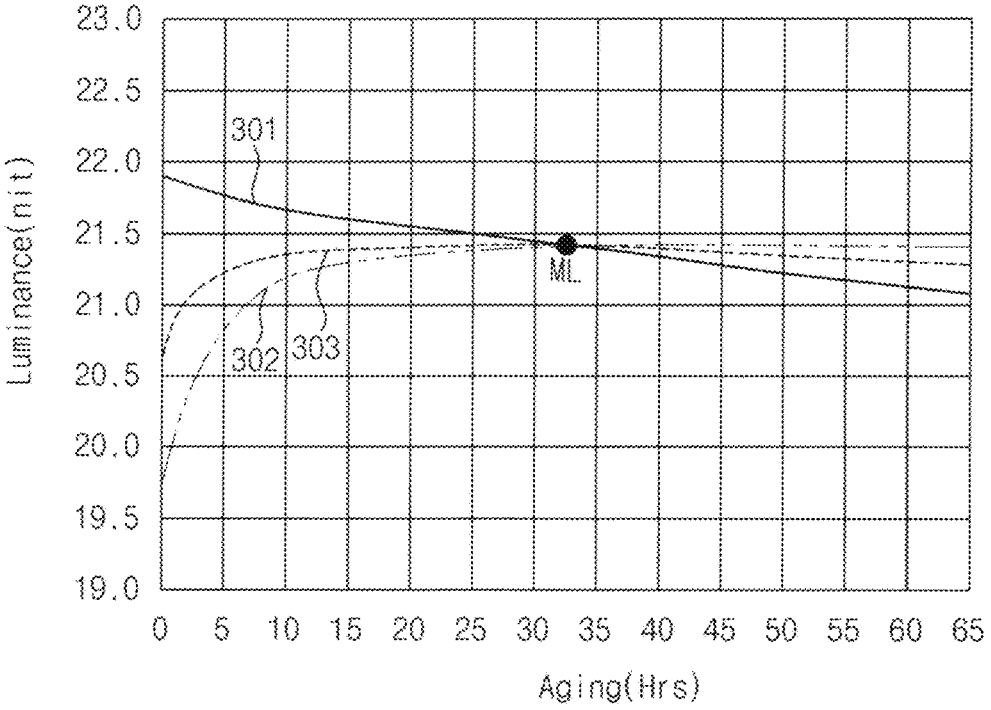
FIG. 9 is a view showing a compensation function graph to which a harmonic mean of the fitting function graphs of FIG. 8 is applied.
Figure 10:
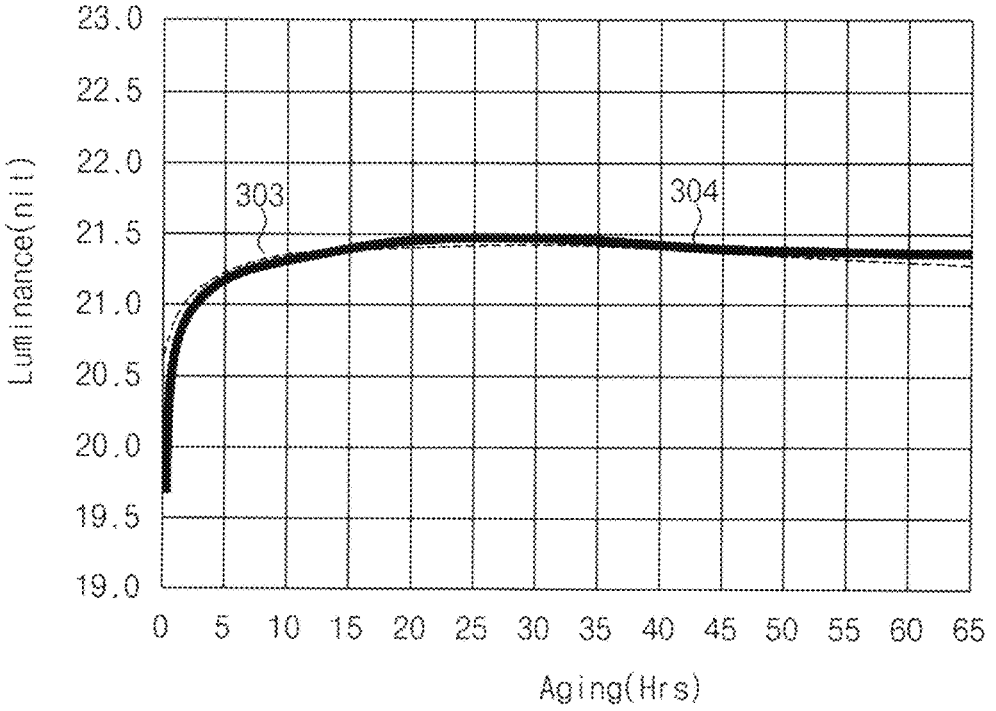
FIG. 10 is a view for comparing the graph of FIG. 7 with the compensation function graph.

FIG. 9 is a view showing a compensation function graph to which a harmonic mean of the fitting function graphs of FIG. 8 is applied, and FIG. 10 is a view for comparing the graph of FIG. 7 with the compensation function graph. In an embodiment, a horizontal axis of FIGS. 9 and 10 may represent a degradation time, and a vertical axis of FIGS. 9 and 10 may represent a luminance, for example.

Referring to FIGS. 2, 8, and 9, after the calculator 131 generates the first fitting function 301 and the second fitting function 302, the compensation function 303 may be generated through the harmonic mean (i.e., the third mathematical formula 330) of the first fitting function 301 and the second fitting function 302. In this case, the harmonic mean refers to a mean of a reciprocal, in which a mean value may be close to a smaller luminance value between a luminance value of the first fitting function 301 and a luminance value of the second fitting function 302.

In some embodiments, a point at which the first fitting function 301 intersects the second fitting function 302 will be defined as a maximum luminance ML, and the calculator 131 may normalize the compensation function 303 so that the maximum luminance ML may correspond to 1.

The compensation value generator 133 may generate the compensation value CV based on the normalized compensation function 303, and the compensation value generator 133 may provide the compensation value CV to the controller 150.

As shown in FIG. 10, the compensation function 303 may have substantially the same shape as that of the graph 304, and the display device 100 may generate an accurate compensation function 303 through the harmonic mean of the first and second fitting functions 301 and 302. Since the accurate compensation function 303 is generated, an accurate compensation value CV may be generated, and when the display device 100 including the inorganic light-emitting diode is driven, the display device 100 may prevent the luminance deviation that occurs initially.

Figure 11:
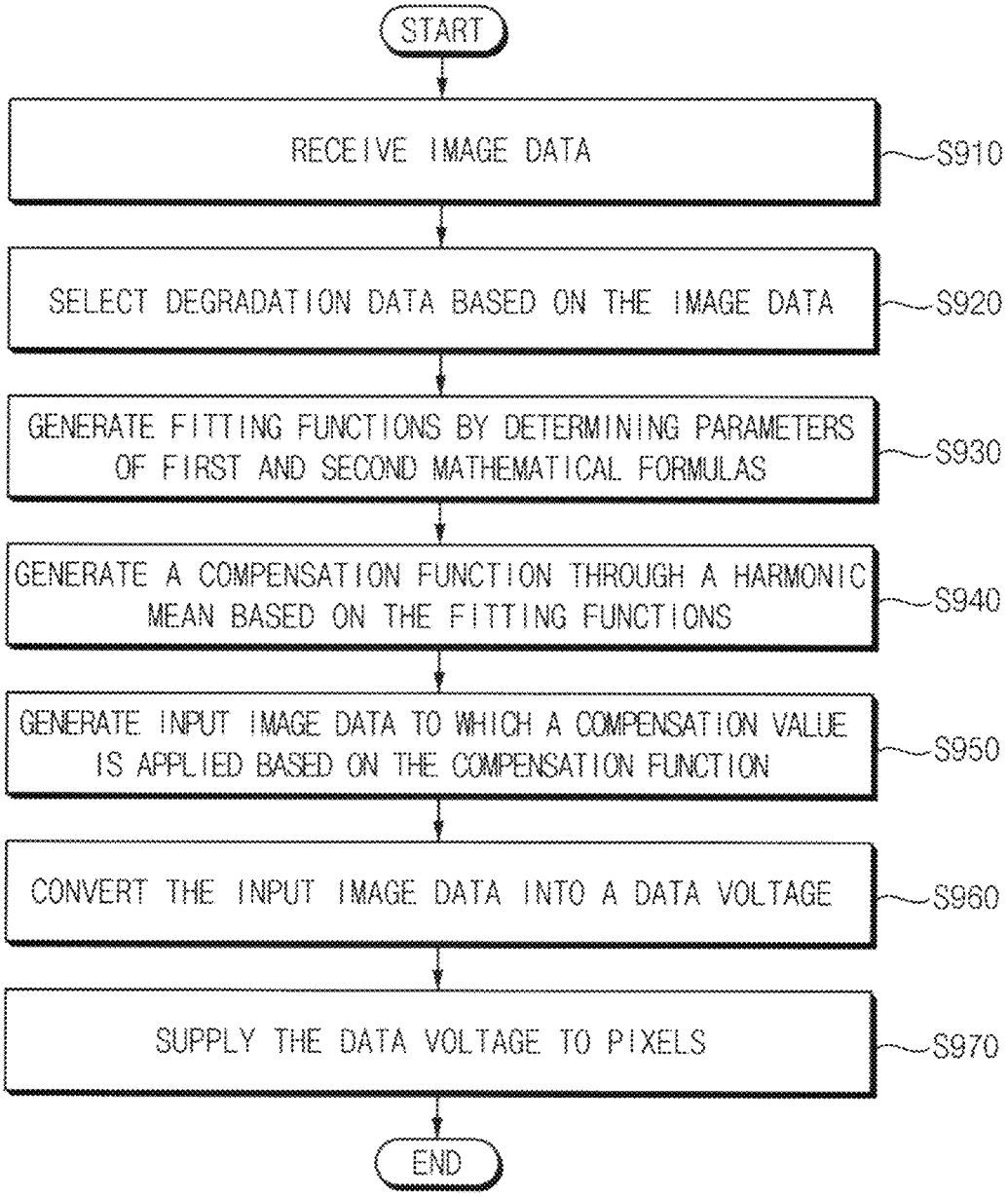
FIG. 11 is a flowchart showing an embodiment of a method of driving a display device according to the invention.

FIG. 11 is a flowchart showing an embodiment of a method of driving a display device according to the invention.

Referring to FIG. 11, a method of driving a display device may include: receiving, by a calculator 131 (or a degradation compensator 130) image data IMG (S910); selecting, by the calculator 131, degradation data based on the image data IMG (S920); generating by the calculator 131, first and second fitting functions 301 and 302 by determining a parameter of each of first and second mathematical formulas 310 and 320 based on the degradation data (S930); generating, by the calculator 131, a compensation function 303 through a harmonic mean based on the first and second fitting functions 301 and 302 (S940); generating, by a compensation value generator 133, a compensation value CV based on the compensation function 303, and generating, by a controller 150, input image data IDATA to which the compensation value CV is applied (S950); converting, by a data driver 120, the input image data IDATA into a data voltage VDATA (S960); and supplying, by the data driver 120, the data voltage VDATA to pixels PX (S970).

Referring back to FIGS. 1, 2, and 11, the calculator 131 of the degradation compensator 130 may receive the image data IMG, and may receive image data information and gray level information.

The calculator 131 may select degradation data corresponding to the gray level information and the image data information among degradation data stored in a memory 132 based on the image data IMG.

Referring back to FIGS. 2, 3, and 11, the calculator 131 may determine a parameter of each of the first and second mathematical formulas 310 and 320 based on the degradation data obtained from the memory 132. In this case, $\tau$ of the first mathematical formula 310 may be a time desired for an initial luminance to be degraded to a preset reference (decay time constant). In an embodiment, when the initial luminance is 100, $\tau$ may be a time desired for the initial luminance to be degraded to about 80%, for example. Further, $\beta$ of the first mathematical formula 310 may be a parameter related to a degradation form, which is a constant determined for each of light-emitting elements regardless of a gray level. Further, t of the first mathematical formula 310 may be a degradation time. In addition, c of the second mathematical formula 320 may be an initial luminance, and a and b of the second mathematical formula 320 may be constants that determine a curvature of an initial curve of an exponential function. Further, t of the second mathematical formula 320 may be a degradation time.

In other words, a first fitting function 301 representing a variation of a luminance with respect to a degradation time may be determined through the first mathematical formula 310, and a second fitting function 302 representing a variation of a luminance with respect to a degradation time may be generated through the second mathematical formula 320. In this case, the first fitting function 301 may correspond to an exponential graph in which a luminance value is gradually decreased according to a time, and the second fitting function 302 may correspond to an exponential graph in which a luminance value is gradually decreased after the luminance value is increased during an initial time.

After the calculator 131 generates the first fitting function 301 and the second fitting function 302, the compensation function 303 may be generated through the harmonic mean (i.e., a third mathematical formula 330) of the first fitting function 301 and the second fitting function 302. In this case, the harmonic mean refers to a mean of a reciprocal, in which a mean value may be close to a smaller luminance value between a luminance value of the first fitting function 301 and a luminance value of the second fitting function 302.

A point at which the first fitting function 301 intersects the second fitting function 302 will be defined as a maximum luminance ML, and the calculator 131 may normalize the compensation function 303 so that the maximum luminance ML may correspond to 1.

The compensation value generator 133 may generate the compensation value CV based on the normalized compensation function 303, and the compensation value generator 133 may provide the compensation value CV to the controller 150.

Referring back to FIGS. 1 and 11, the controller 150 may convert the image data IMG into the input image data IDATA by applying the compensation value CV generated by the degradation compensator 130, and the controller 150 may provide the input image data IDATA to which the compensation value CV is applied to the data driver 120.

The data driver 120 may receive the input image data IDATA to which the compensation value CV is applied. The data driver 120 may convert the input image data IDATA into the data voltage VDATA. The data driver 120 may supply the data voltage VDATA to the pixels PX connected to data lines DL based on a data control signal CTLD.

Figure 12:
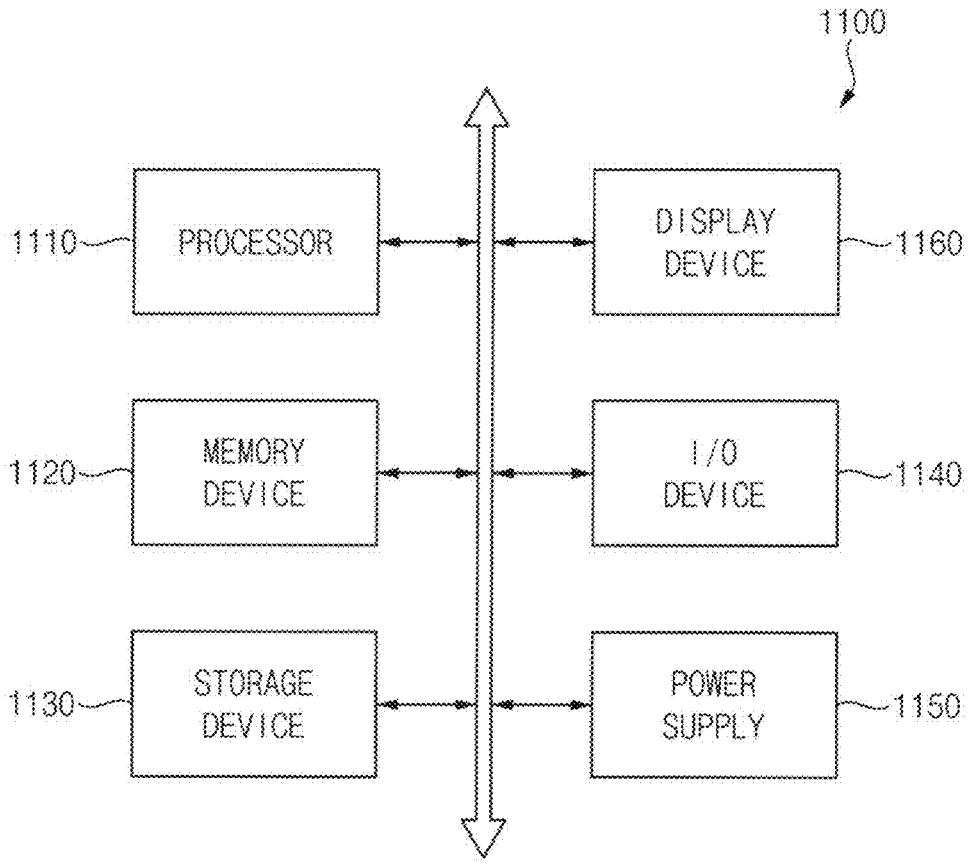
FIG. 12 is a block diagram illustrating an electronic device including a display device according to the invention.

FIG. 12 is a block diagram illustrating an electronic device including a display device according to the invention.

Referring to FIG. 12, an electronic device 1100 may include a processor 1110, a memory device 1120, a storage device 1130, an input/output ("I/O") device 1140, a power supply 1150, and a display device 1160. In an embodiment, the electronic device 1100 may further include a plurality of ports for communicating with a video card, a sound card, a memory card, a universal serial bus ("USB") device, other electric devices, etc.

The processor 1110 may perform various computing functions or tasks. In an embodiment, the processor 1110 may be an application processor ("AP"), a microprocessor, a central processing unit ("CPU"), etc. The processor 1110 may be coupled to other components via an address bus, a control bus, a data bus, etc. Further, in embodiments, the processor 1110 may be further coupled to an extended bus such as a peripheral component interconnection ("PCI") bus.

The memory device 1120 may store data for operations of the electronic device 1100. In an embodiment, the memory device 1120 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile dynamic random access memory ("mobile DRAM") device, etc., for example.

In an embodiment, the storage device 1130 may be a solid state drive ("SSD") device, a hard disk drive ("HDD") device, a CD-ROM device, etc. In an embodiment, the I/O device 1140 may be an input device such as a keyboard, a keypad, a mouse, a touch screen, etc., and an output device such as a printer, a speaker, etc. The power supply 1150 may supply power for operations of the electronic device 1100. The display device 1160, e.g., an OLED display device 1160, may be coupled to other components through the buses or other communication links.

In an embodiment, the display device 1160 may include a display panel including a plurality of pixels, a controller, a data driver, a gate driver, an emission driver, a power supply unit, a degradation compensator, or the like. Here, the degradation compensator may include a calculator, a memory, and a compensation value generator. In addition, the display panel may include a substrate, a pixel circuit, an inorganic light-emitting diode, a first quantum dot layer, a second quantum dot layer, a scattering layer, or the like. In an embodiment, the display device 1160 includes the degradation compensator capable of generating the compensation value by generating the compensation function through the harmonic mean of the first and second fitting functions, when the display device 1160 is driven, the display device 1160 may prevent a luminance deviation that occurs initially. Accordingly, display quality of the display device 1160 may be improved.

In an embodiment, the electronic device 1100 may be any electronic device including the display device 1160 such as a smart phone, a wearable electronic device, a tablet computer, a mobile phone, a television ("TV"), a digital TV, a three dimensional ("3D") TV, a personal computer ("PC"), a home appliance, a laptop computer, a personal digital assistant ("PDA"), a portable multimedia player ("PMP"), a digital camera, a music player, a portable game console, a navigation device, or the like.

Embodiments of the invention may be applied to various electronic devices including a display device. In an embodiment, the invention may be applied to numerous electronic devices such as vehicle-display devices, ship-display devices, aircraft-display devices, portable communication devices, exhibition display devices, information transfer display devices, medical-display devices, etc., for example.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the invention. Accordingly, all such modifications are intended to be included within the scope of the invention as defined in the claims. Therefore, it is to be understood that the foregoing is illustrative of various embodiments and is not to be construed as limited to the illustrative embodiments disclosed, and that modifications to the disclosed embodiments, as well as other embodiments, are intended to be included within the scope of the appended claims.

What is claimed is:

1. A display device comprising:

a degradation compensator which generates a first fitting function and a second fitting function based on image data, generates a compensation function through a harmonic mean of the first and second fitting functions, and generates a compensation value based on the compensation function;

a controller which receives the compensation value, and generates input image data to which the compensation value is applied;

a data driver which receives the input image data to which the compensation value is applied, and converts the input image data into a data voltage; and a display panel including pixels, each of the pixels including:

a pixel circuit which receives the data voltage; and a light-emitting element electrically connected to the pixel circuit.

2. The display device of claim 1, wherein the first fitting function includes an exponential function in which a luminance value of a pixel, among the pixels, with respect to a degradation time of the pixel is gradually decreased.

3. The display device of claim 1, wherein the first fitting function is expressed by a first mathematical formula "exp $[-(t/\tau)^{\beta}]$", where $\tau$ is a time desired for an initial luminance of a pixel, among the pixels, to be degraded to a preset reference (decay time constant), $\beta$ is a parameter related to a degradation form of the pixel, which is a constant determined for each of pixels regardless of a gray level, and t is a degradation time of the pixel.

4. The display device of claim 1, wherein the second fitting function includes an exponential function in which a luminance value of a pixel, among the pixels, is gradually decreased after the luminance value of the pixel is increased during an initial degradation time of the pixel.

5. The display device of claim 1, wherein the second fitting function is expressed by a second mathematical formula "a·exp[b·t]+c", where c is an initial luminance of a pixel among the pixels, and a and b of the second mathematical formula are constants which determines a curvature of an initial curve of an exponential function, and t is a degradation time of the pixel.

6. The display device of claim 1, wherein the harmonic mean is expressed by a third mathematical formula $$\frac{\text{“}2xy\text{”}}{x+y},$$

where x is a luminance value of a first fitting function, and y is a luminance value of a second fitting function.

7. The display device of claim 1, wherein the degradation compensator includes:

a memory which stores degradation data in which variations of luminances of the pixels with respect to a gray level and a degradation time are stored as numerical values;

a calculator which receives the image data including gray level information and image data information, selects degradation data corresponding to the gray level information and the image data information among the degradation data stored in the memory, determines a parameter of each of first and second mathematical formulas based on the degradation data, generates each of the first and second fitting functions, and generates the compensation function; and a compensation value generator which generates the compensation value based on the compensation function, and provides the compensation value to the controller.

8. The display device of claim 1, wherein the light-emitting element includes an inorganic light-emitting diode.

9. The display device of claim 8, wherein the inorganic light-emitting diode is driven with a maximum luminance after a preset time without being driven with the maximum luminance upon initial driving.

10. The display device of claim 8, wherein the light-emitting element includes an anode electrode, a cathode electrode, and an inorganic light-emitting layer disposed between the anode electrode and the cathode electrode, and the inorganic light-emitting layer emits a blue light.

11. The display device of claim 1, wherein the pixel circuit includes at least one driving transistor, at least one switching transistor, and at least one storage capacitor.

12. The display device of claim 1, wherein each of the pixels further includes a first quantum dot layer, a second quantum dot layer, and a scattering layer, which are disposed on the light-emitting element.

13. The display device of claim 12, wherein the light-emitting element emits a blue light.

14. The display device of claim 12, wherein the first quantum dot layer converts a blue light into a red light, the second quantum dot layer converts the blue light into a green light, and the scattering layer transmits the blue light.

15. The display device of claim 1, further comprising:

a gate driver which generates a data write gate signal, a data initialization gate signal, and a light-emitting element initialization signal, and provides the data write gate signal, the data initialization gate signal, and the light-emitting element initialization signal to the pixel circuit;

an emission driver which generates an emission signal, and provide the emission signal to the pixel circuit; and a power supply unit which generates a first power supply voltage, a second power supply voltage, and an initialization voltage, and provide the first power supply voltage, the second power supply voltage, and the initialization voltage to the pixel circuit.

16. The display device of claim 15, wherein the controller controls an operation of each of the data driver, the gate driver, and the emission driver.

17. A method of driving a display device, the method comprising:

receiving image data;

selecting degradation data based on the image data;

generating each of first and second fitting functions by determining a parameter of each of first and second mathematical formulas;

generating a compensation function through a harmonic mean based on the first and second fitting functions;

generating a compensation value based on the compensation function, and generating input image data to which the compensation value is applied;

converting the input image data into a data voltage; and supplying the data voltage to pixels.

18. The method of claim 17, wherein the first mathematical formula is expressed as "$\exp[-(t/\tau)^{\beta}]$", where $\tau$ is a time desired for an initial luminance of a pixel, among the pixels, to be degraded to a preset reference (decay time constant), $\beta$ is a parameter related to a degradation form of the pixel, which is a constant determined for each of the pixels regardless of a gray level, and t is a degradation time of the pixel, wherein the second mathematical formula is expressed as "a·exp[b·t]+c", where c is an initial luminance of the pixel, and a and b of the second mathematical formula are constants which determine a curvature of an initial curve of an exponential function, and wherein the harmonic mean is expressed as $$\frac{\text{“}2xy\text{”}}{x+y},$$

where x is a luminance value of a first fitting function, and y is a luminance value of a second fitting function.

19. The method of claim 17, wherein the degradation compensator includes:

a memory which stores degradation data in which variations of luminances of the pixels with respect to a gray level and a degradation time are stored as numerical values;

a calculator which receives the image data including gray level information and image data information, selects the degradation data corresponding to the gray level information and the image data information among the degradation data stored in the memory, determines the parameter of each of the first and second mathematical formulas based on the degradation data, generates each of the first and second fitting functions, and generates the compensation function; and a compensation value generator which generates the compensation value based on the compensation function.

20. The method of claim 17, wherein each of the pixels includes:

a pixel circuit;

a light-emitting element which is disposed on the pixel circuit, emits a blue light, and includes an inorganic light-emitting layer; and a first quantum dot layer, a second quantum dot layer, and a scattering layer, which are disposed on the light-emitting element.

* * * * *